US006837831B2

(12) United States Patent
Lee

(10) Patent No.: US 6,837,831 B2
(45) Date of Patent: Jan. 4, 2005

(54) COMBINED EXERCISER/MASSAGE DEVICE

(76) Inventor: Chin-Tsun Lee, No. 32, Lane 6, Kuokuang 7th St., Yung Kang City, Tainan Hsien (TW)

( * ) Notice: Subject to any disclaimer, the term of this patent is extended or adjusted under 35 U.S.C. 154(b) by 0 days.

(21) Appl. No.: 10/323,309

(22) Filed: Dec. 19, 2002

(65) Prior Publication Data

US 2004/0121886 A1 Jun. 24, 2004

(51) Int. Cl.[7] ..... A63B 22/06
(52) U.S. Cl. ..... 482/60; 482/57
(58) Field of Search ..... 482/51–65, 140, 482/142, 148

(56) References Cited

U.S. PATENT DOCUMENTS 4,150,667 A * 4/1979 Takeuchi ..... 601/32
4,180,063 A * 12/1979 Takeuchi ..... 601/32
4,682,771 A * 7/1987 Jean ..... 482/57
4,986,261 A * 1/1991 Iams et al. ..... 601/35

* cited by examiner

*Primary Examiner*—Nicholas D. Lucchesi
*Assistant Examiner*—Tam Nguyen
(74) *Attorney, Agent, or Firm*—Charles E. Baxley

(57) ABSTRACT

A combined exerciser/massage device includes a base, a shaft rotatably mounted to the base, two cranks respectively mounted to two ends of the shaft, and two pedals respectively mounted to the cranks. Each pedal has at least one massage member provided thereon for massaging a sole of a user's foot on the pedal. Two legrests are provided on the base and each has at least one massage member provided thereon for massaging one of a calf and a ham of a user's leg that is cycling an associated one of the pedals.

1 Claim, 11 Drawing Sheets

COMBINED EXERCISER/MASSAGE DEVICE

BACKGROUND OF THE INVENTION

1. Field of the Invention

The present invention relates to a combined exerciser/massage device that allows a user to massage the calves or hams of his or her legs while exercising.

2. Description of the Related Art

A cycling exerciser allows a user to exercise his or her legs while he or she is sitting or lying down on the floor. The blood circulation is improved, which is particularly useful to a person that has sat for hours. However, the cycling exerciser could not provide other functions such as massage. Further, the shank of the user is not supported while "cycling." The utility of the cycling exerciser is thus limited.

SUMMARY OF THE INVENTION

It is an object of the present invention to provide a combined exerciser/massage device that allows a user to massage the calves or hams of his or her legs while exercising.

A combined exerciser/massage device in accordance with the present invention includes a base, a shaft rotatably mounted to the base, two cranks respectively mounted to two ends of the shaft, and two pedals respectively mounted to the cranks. Each pedal has at least one massage member provided thereon for massaging a sole of a user's foot on the pedal. A legrest portion is provided on the base and has at least one massage member for massaging one of a calf and a ham of a user's leg that is cycling an associated one of the pedals. In an embodiment of the invention, two legrests are provided on the base. Each legrest has at least one massage member provided thereon for massaging one of a calf and a ham of a user's leg that is cycling an associated one of the pedals.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
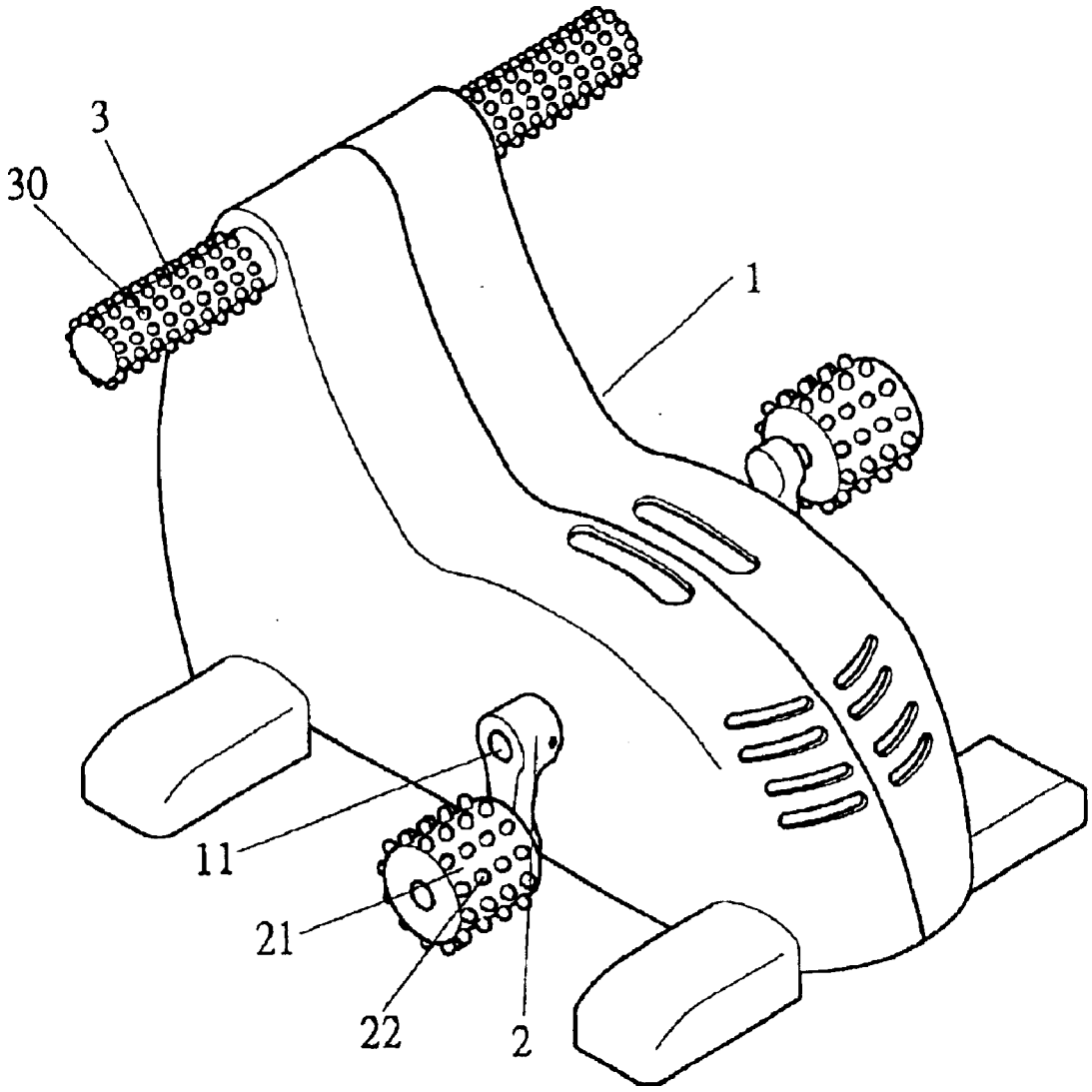
FIG. 1 is a perspective view of a first embodiment of a combined exerciser/massage device in accordance with the present invention.

Referring to FIG. 1, a first embodiment of a combined exerciser/massage device in accordance with the present invention generally includes a base 1, a shaft 11 rotatably mounted in the base 1 and extending from a side of the base 1 to the other side of the base 1, two cranks 2 each having an end fixed to an associated one of two ends of the shaft 11, and two pedals 21 each of which attached to the other end of an associated one of the cranks 2. Each pedal 21 has at least one massage member 22 formed on an outer periphery thereof. In this embodiment, each pedal 21 has a plurality of protrusions 22 on the outer periphery thereof. At least one legrest portion is provided on the base 1. In this embodiment, two legrests 3 are provided on the base 1 at a level higher than the shaft 11. Each pedal 3 has at least one massage member 30 formed on an outer periphery thereof. In this embodiment, each pedal 3 has a plurality of protrusions 30 on the outer periphery thereof.

Figure 2:
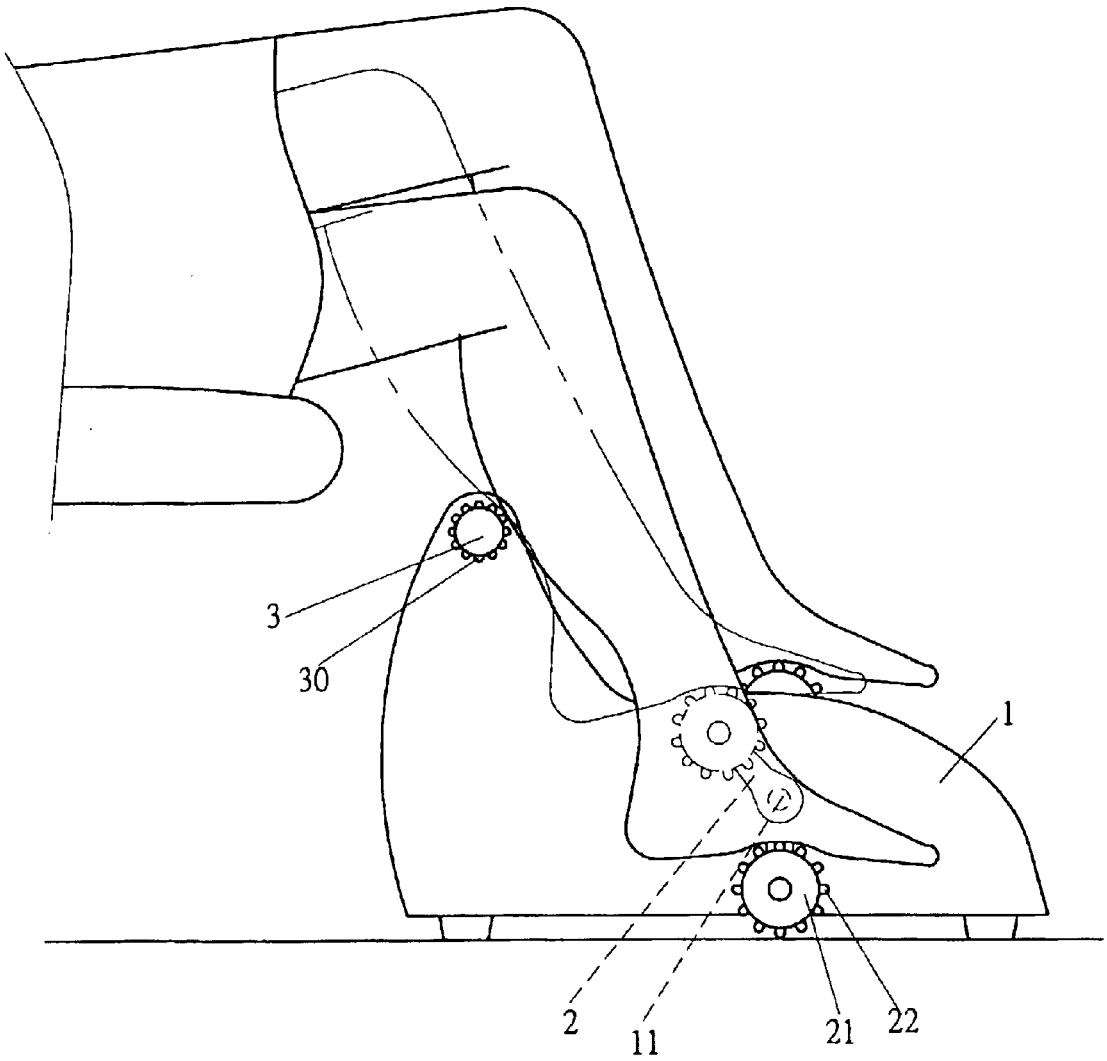
FIG. 2 is a schematic side view illustrating use of the combined exerciser/massage device in FIG. 1.

As illustrated in FIG. 2, the user may sit on a chair with his or her feet cycling the pedals 21. The soles of the user's feet and the calves of the user's legs are massaged while the user is cycling.

Figure 3:
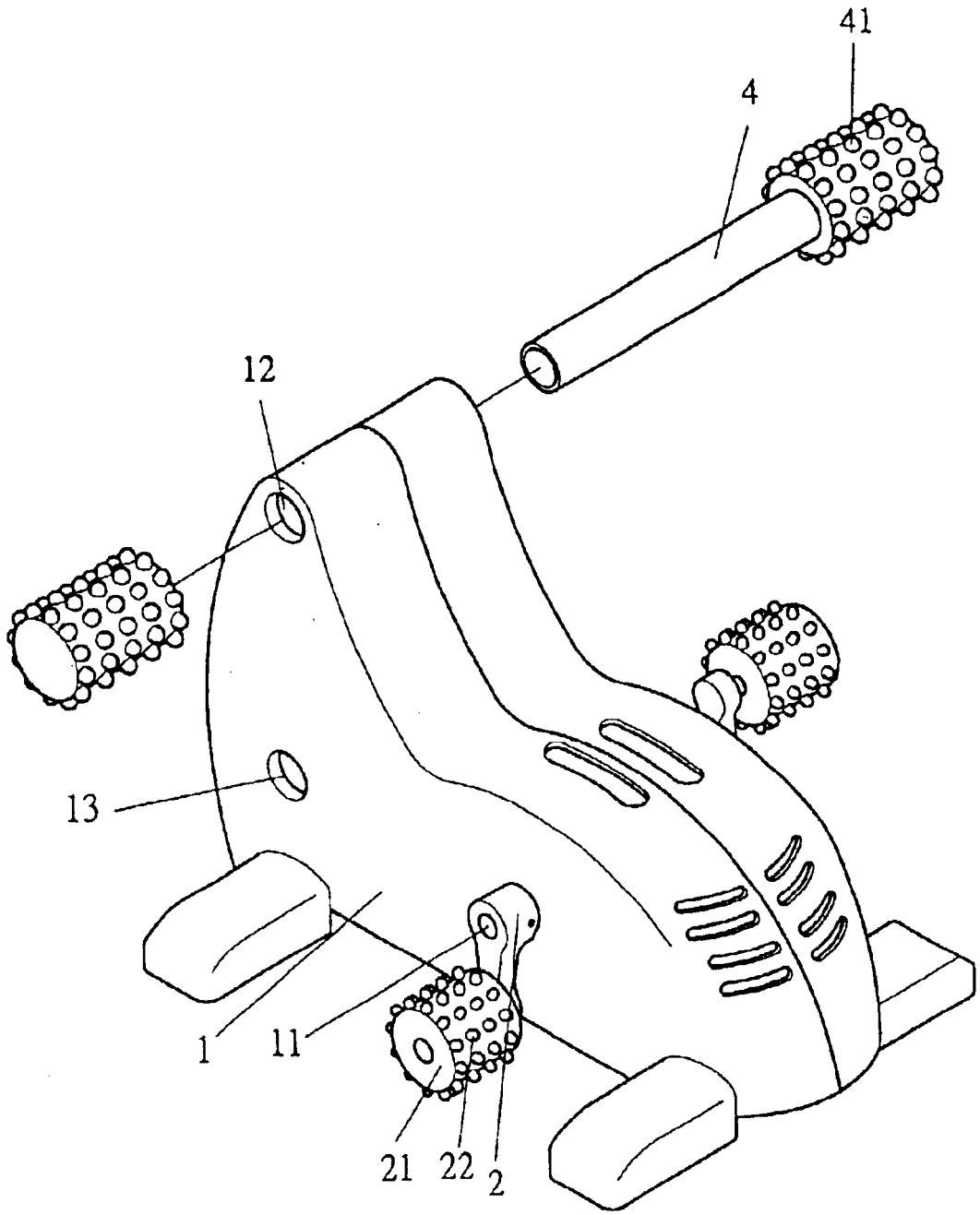
FIG. 3 is a perspective view, partly exploded, of a second embodiment of the combined exerciser/massage device in accordance with the present invention.
Figure 4:
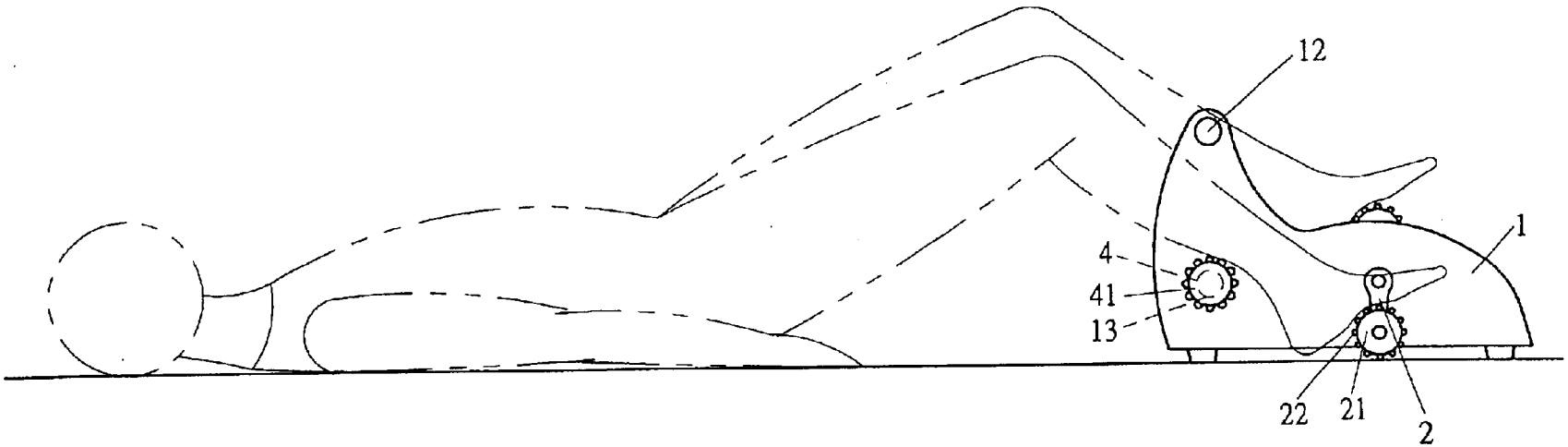
FIG. 4 is a schematic side view illustrating use of the combined exerciser/massage device in FIG. 3.

FIG. 3 illustrates a second embodiment of the combined exerciser/massage device in accordance with the present invention. In this embodiment, the base 1 includes an upper transverse hole 12 extending in a direction parallel to an extending direction of the shaft 11 and a lower transverse hole 13 extending in a direction parallel to the extending direction of the shaft 11. The lower transverse hole 13 is located at a level slightly higher than the shaft 11, and the upper transverse hole 12 is located at a level higher than the lower transverse hole 13. Further, the combined exerciser/massage device includes a transverse rod 4 that is selectively extended through one of the upper transverse hole 12 and the lower transverse hole 13, and a legrest 41 is mounted to each of two ends of the transverse rod 4. Each legrest 41 has a plurality of protrusions (not labeled) for providing massage. As illustrated in FIG. 4, the user may lie down on the floor with his or her feet cycling the pedals 21. The soles of the user's feet and the calves of the user's legs are massaged while the user is cycling.

Figure 5:
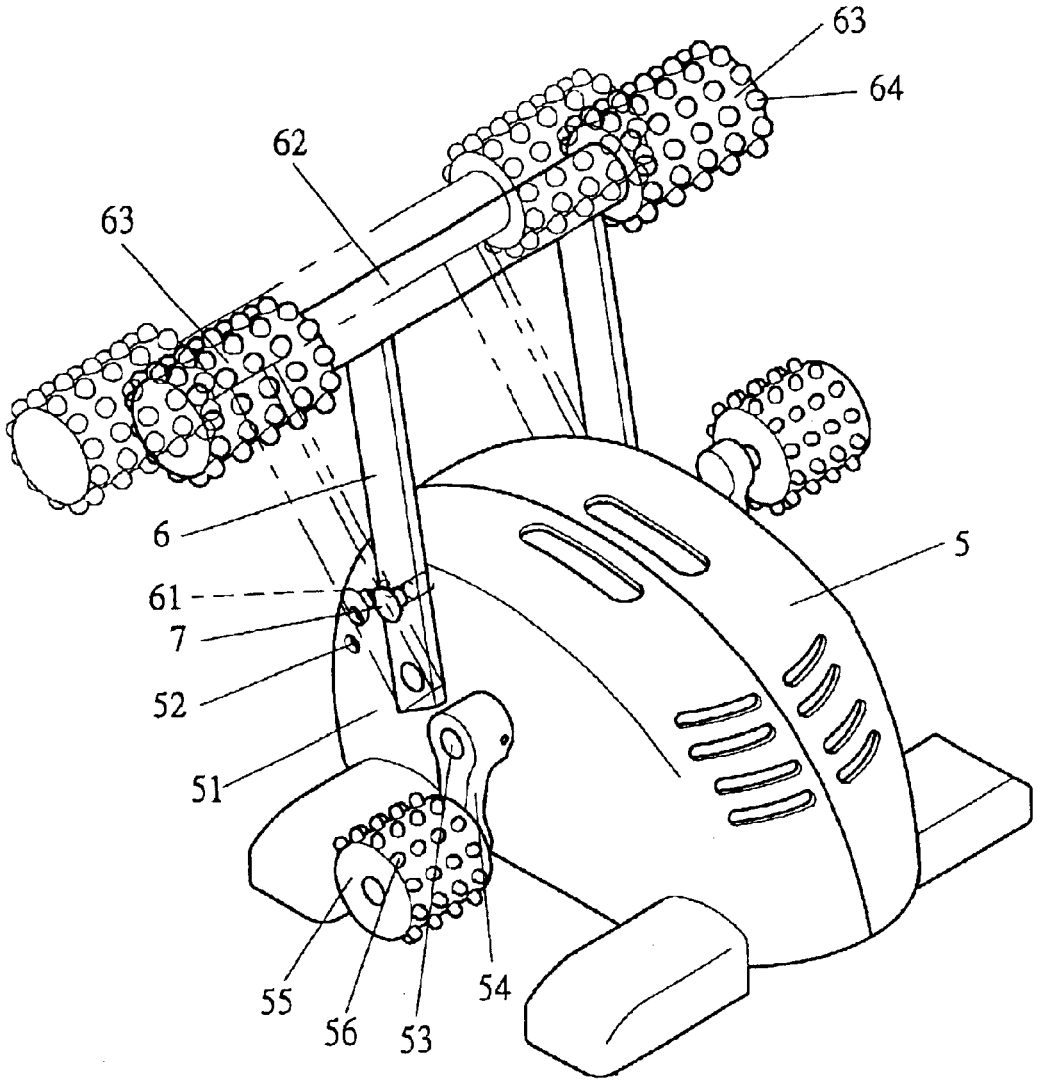
FIG. 5 is a perspective view of a third embodiment of the combined exerciser/massage device in accordance with the present invention.

FIG. 5 illustrates a third embodiment of the combined exerciser/massage device in accordance with the present invention. In this embodiment, the combined exerciser/massage device includes a base 5, a shaft 53, two cranks 54, and two pedals 55 each having a plurality of protrusions 56 for massage purposes, which are identical to those of the first embodiment. Further, the third embodiment of the combined exerciser/massage device includes a connecting portion 51 on a rear side of the base 5. The connecting portion 51 has a plurality of positioning holes 52 on a side of the base 5. Two pivotal rods 6 are provided and each has a lower end pivotally mounted to an associated one of two sides of the base 1 and an upper end that is connected to a transverse rod 62. Two legrests 63 are respectively mounted on two ends of the transverse rod 62. A plurality of protrusions 64 are provided on each legrest 63 for message purposes. A pin 7 is extended through a hole 61 in one of the pivotal rods 6 and through one of the positioning holes 52 of the base 5, thereby positioning the legrests 63 in a desired position.

Figure 6:
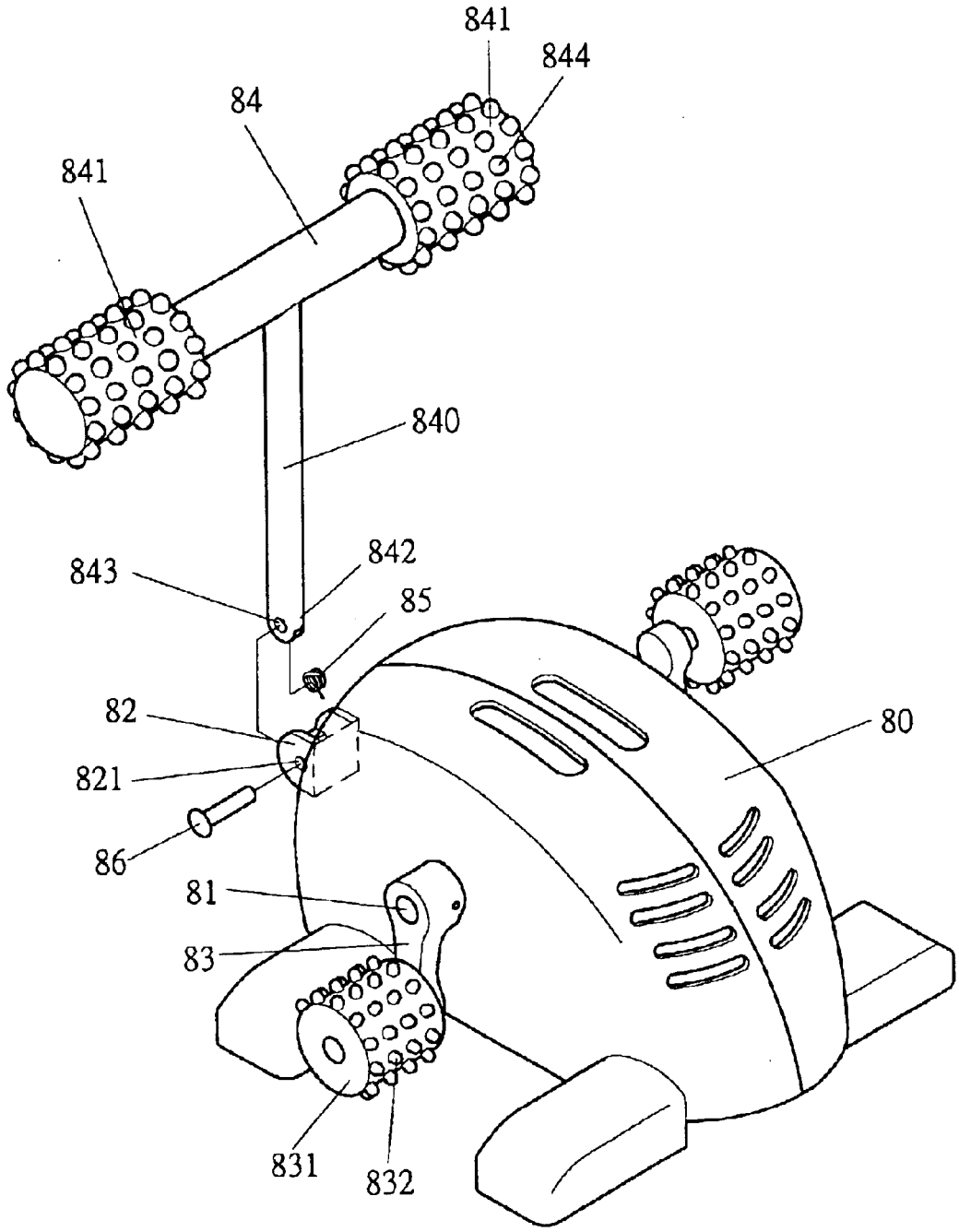
FIG. 6 is a perspective view, partly exploded, of a fourth embodiment of the combined exerciser/massage device in accordance with the present invention.
Figure 7:
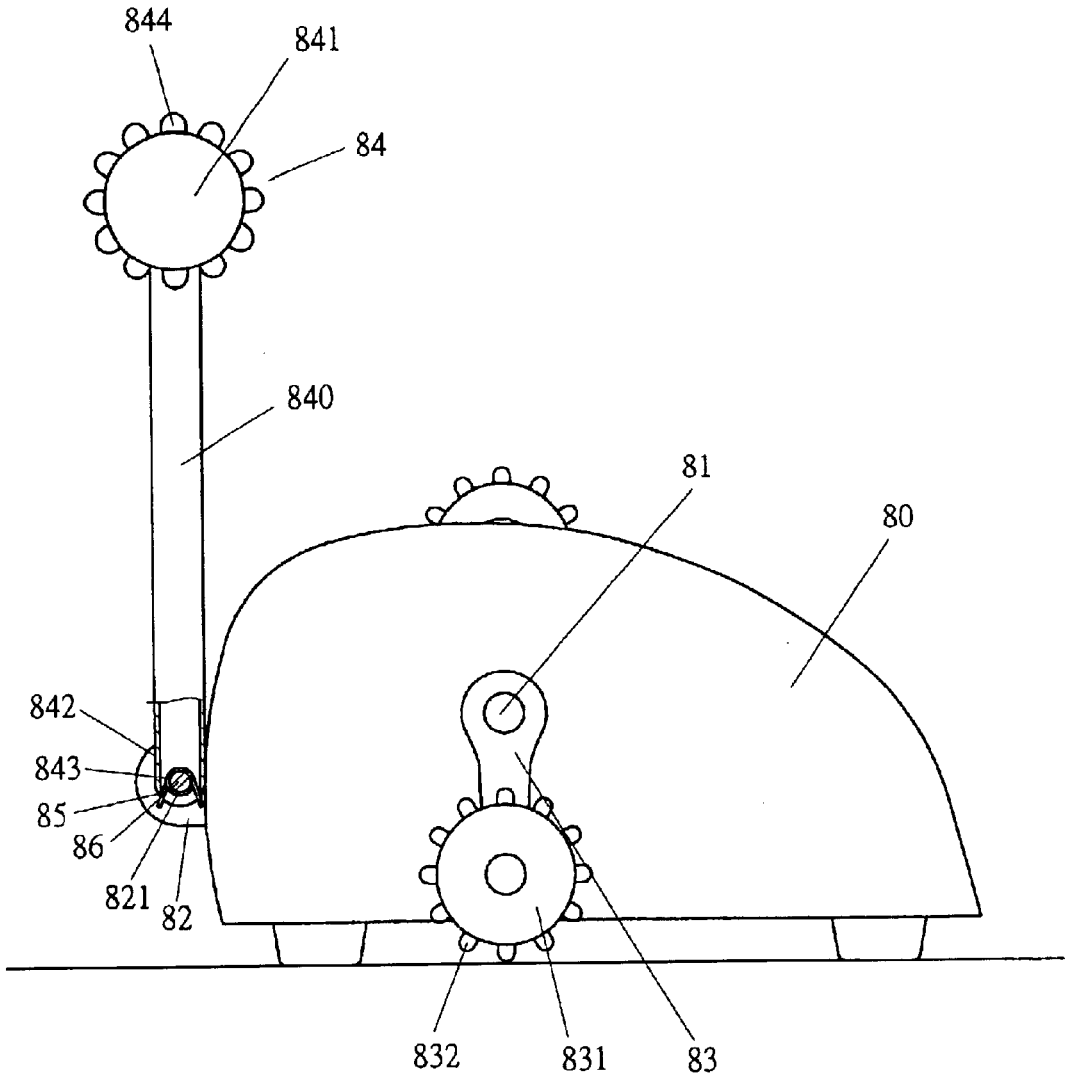
FIG. 7 is a side view of the combined exerciser/massage device in FIG. 6.
Figure 8:
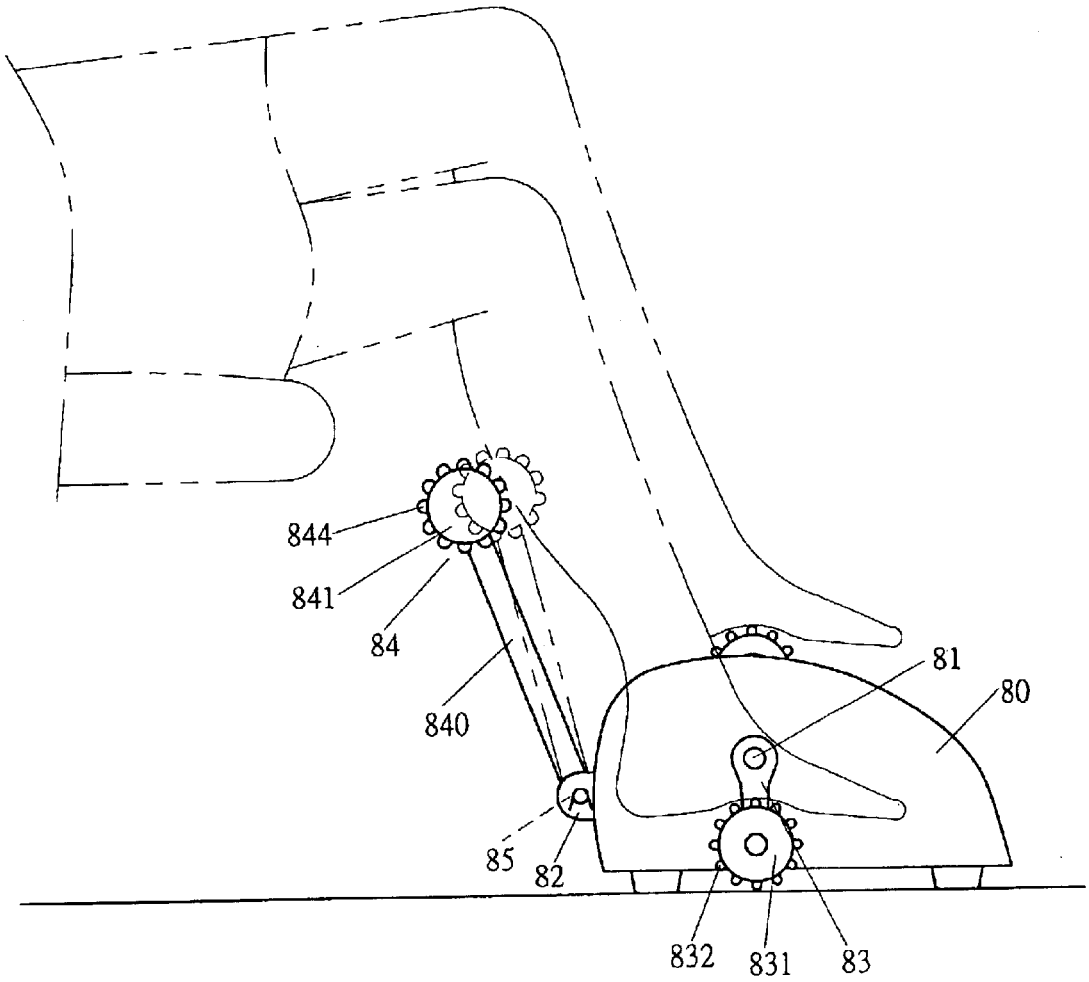
FIG. 8 is a schematic side view illustrating use of the combined exerciser/massage device in FIG. 6.
Figure 9:
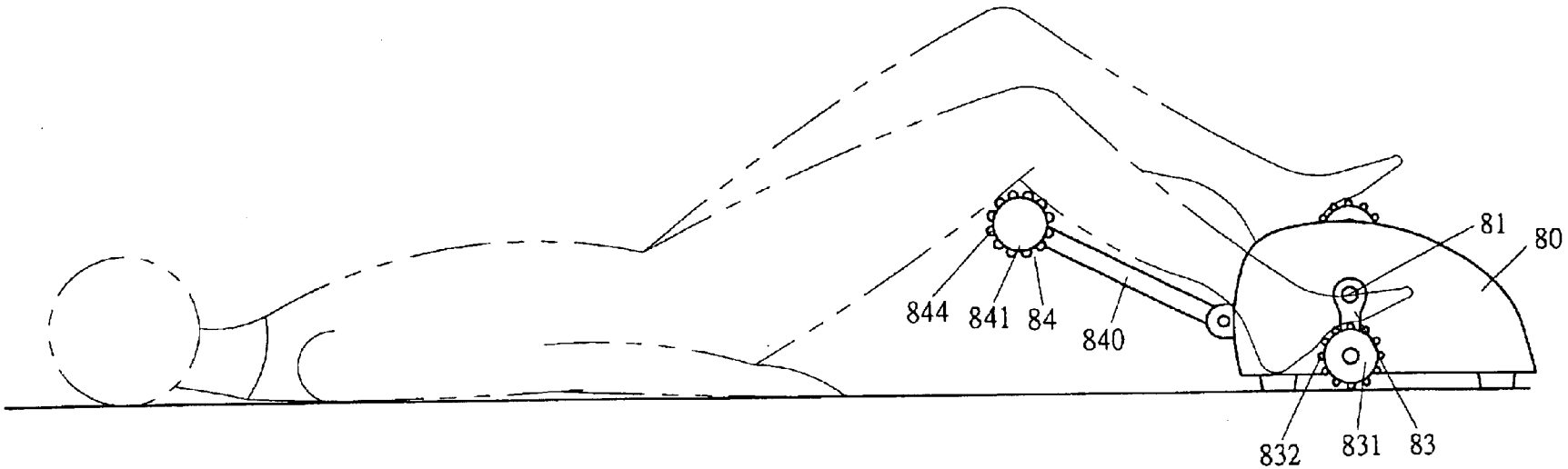
FIG. 9 is a schematic side view illustrating use of the combined exerciser/massage device in FIG. 6.

FIGS. 6 and 7 illustrate a fourth embodiment of the combined exerciser/massage device in accordance with the present invention. In this embodiment, the combined exerciser/massage device includes a base 80, a shaft 81, two cranks 83, and two pedals 831 each having a plurality of protrusions 832 for massage purposes, which are identical to those of the first embodiment. Further, the fourth embodiment of the combined exerciser/massage device includes a bracket 82 fixed to a rear side of the base 80. The bracket 82 includes two spaced lugs (not labeled) having aligned pinholes 821. A pin 86 is extended through the pinholes 821 of the bracket 82 and a hole 843 in a lower end 842 of a pivotal rod 840, thereby pivotally connecting the pivotal rod 840 to the bracket 82. A torsion spring 85 is mounted around the pin 86. An upper end of the pivotal rod 840 is fixed to a transverse rod 84. Two legrests 841 are respectively mounted on two ends of the transverse rod 84. A plurality of protrusions 844 are provided on each legrest 841 for massage purposes. FIG. 8 is a schematic side view illustrating use of the combined exerciser/massage device in FIG. 6. The user may sit on a chair with his or her feet cycling the pedals 831. When cycling, the torsion spring 85 biases the pivotal rod 840 toward the base 80, thereby causing the legrests 841 to be in contact with the calves of the user's legs for massage purposes. The soles of the user's feet and the calves of the user's legs are massaged while the user is cycling. FIG. 9 is a schematic side view illustrating use of the combined exerciser/massage device in FIG. 6. The user may lie down on the floor with his or her feet cycling the pedals 831. When cycling, the torsion spring 85 biases the pivotal rod 840 toward the base 80, thereby causing the legrests 841 to be in contact with the hams of the user's legs for massage purposes. The soles of the user's feet and the hams of the user's legs are massaged while the user is cycling.

Figure 10:
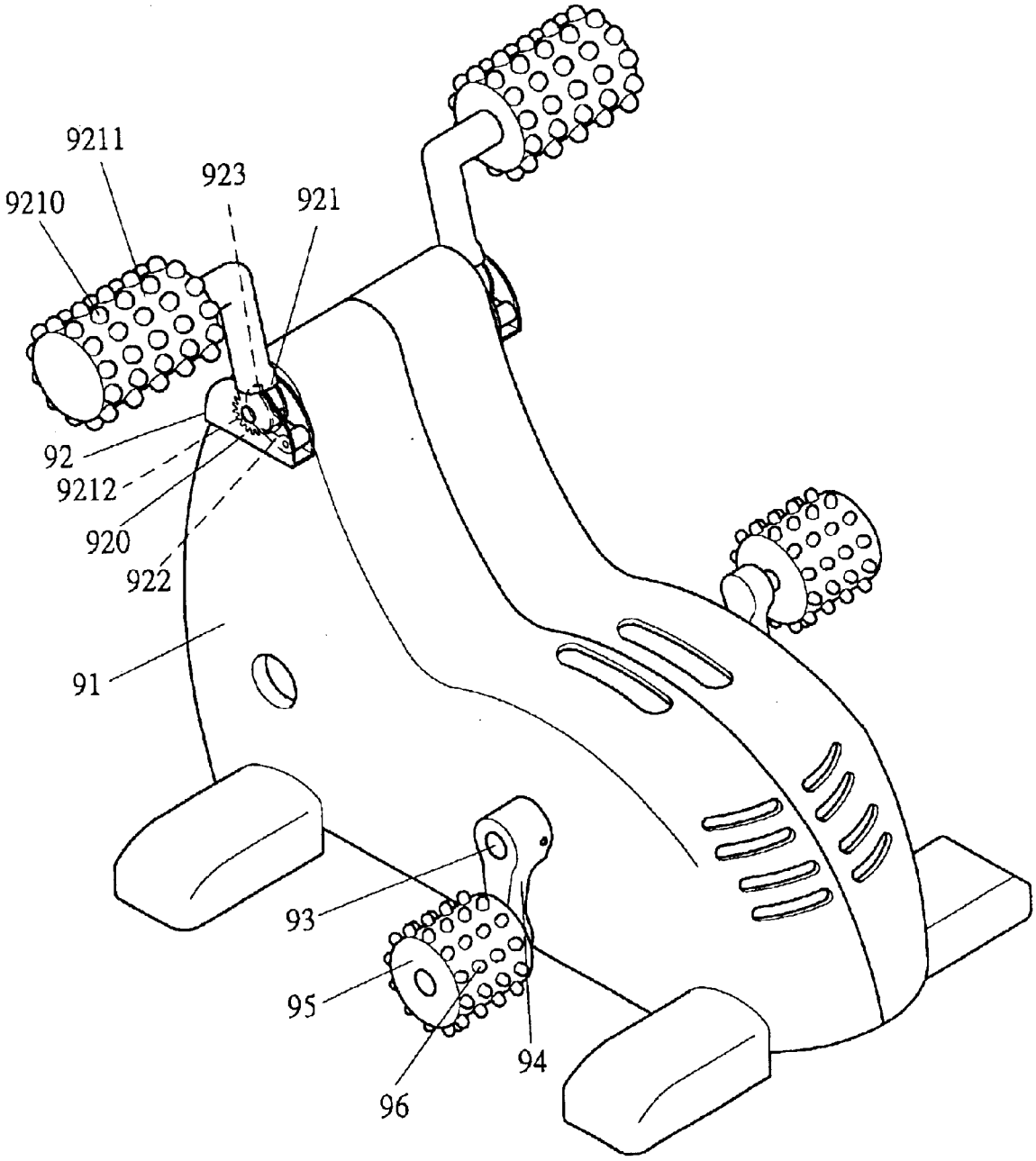
FIG. 10 is a perspective view of a fifth embodiment of the combined exerciser/massage device in accordance with the present invention.
Figure 11:
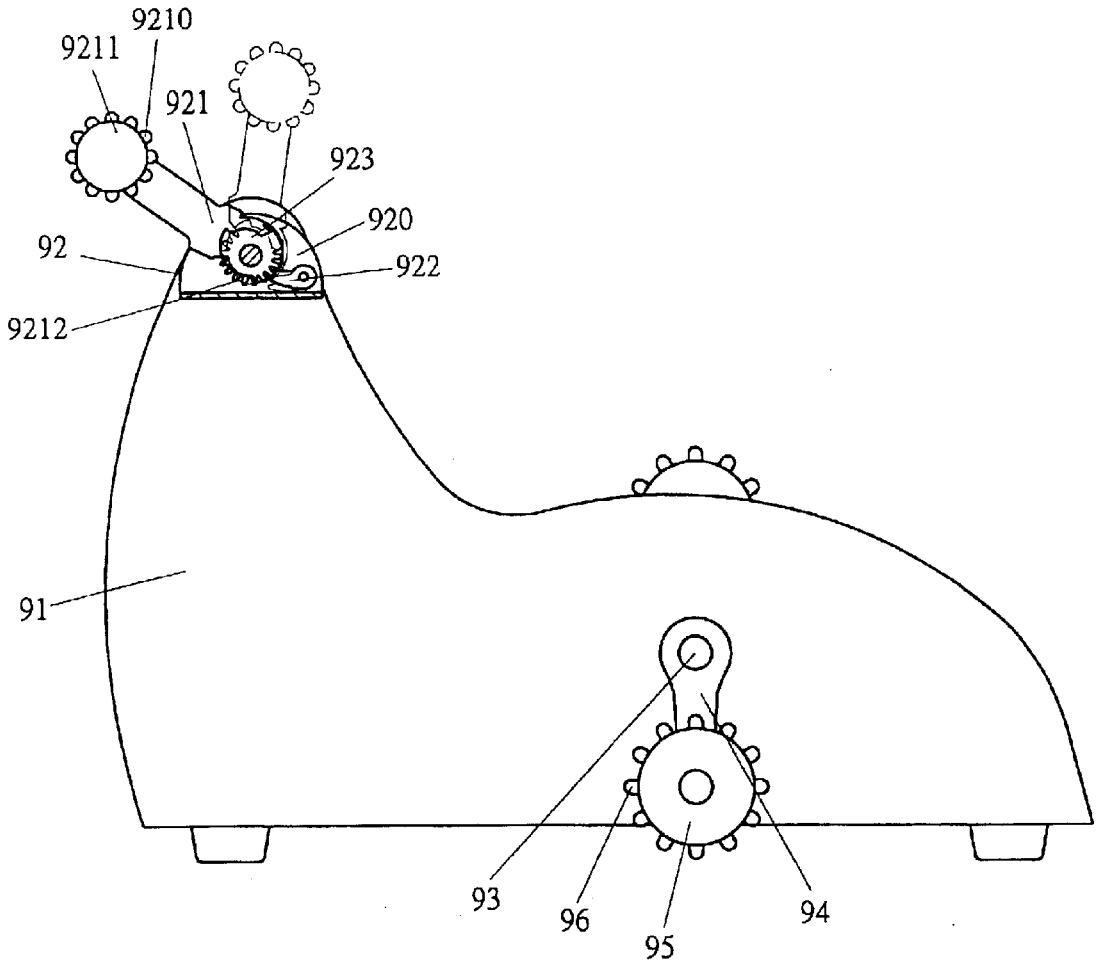
FIG. 11 is a schematic side view illustrating adjustment of the combined exerciser/massage device in FIG. 10.

FIGS. 10 and 11 illustrate a fifth embodiment of the combined exerciser/massage device in accordance with the present invention. In this embodiment, the combined exerciser/massage device includes a base 91, a shaft 93, two cranks 94, and two pedals 95 each having a plurality of protrusions 96 for massage purposes, which are identical to those of the first embodiment. Further, the fifth embodiment of the combined exerciser/massage device includes a clutch device 92 on each of two sides of the base 91. Each clutch device 92 includes a fixed seat 920 fixed to an associated side of the base 91, a movable seat 921 having an end rotatably mounted to the fixed seat 920, a catch 922 rotatably mounted to the fixed seat 920, and a clutch plate 923 mounted to the movable seat 921 to move therewith. The movable seat 921 includes an a legrest 9211 mounted on the other end thereof, a plurality of protrusions 9210 being provided on the legrest 9211 for massage purposes. A plurality of teeth 9212 are formed on the end of the movable seat 921 for releasable engagement with the catch 922. The clutch plate 923 is turned when the movable seat 921 is turned, causing the catch 922 to disengage from the teeth 9212 of the movable seat 921. The user may selectively engage the catch 922 between two teeth 9212 to thereby adjust the position of the legrest 9211. The movable seat 921 can be moved to cause movement of the clutch plate 923, causing the catch 922 to disengage from the teeth 9212 to return the movable seat 921. Although the invention has been explained in relation to its preferred embodiments, it is to be understood that many other possible modifications and variations can be made without departing from the scope of the invention as hereinafter claimed.

What is claimed is:

1. A stand-alone exercise/massage apparatus comprising:

a base;

a shaft rotatably mounted to the base and having two ends;

two cranks respectively mounted to the ends of the shaft;

two pedals respectively mounted to the cranks, two calfrests provided on the base, each said calfrest having at least one massage member provided thereon for massaging one of a calf of a user's leg that is cycling an associated one of said pedals;

wherein the base includes a plurality of positioning holes in one of two sides thereof, further including two pivotal rods each having a lower end pivotally connected to an associated side of the base and an upper end connected to a transverse rod;

with the calfrests respectively mounted on two ends of the transverse rod, with one of the pivot rods having a hole, with a pin extending through the hole of said one of the pivot rods and through one of the positioning holes of the base.

* * * * *